United States Patent [19]

Schaap et al.

[11] 4,282,106

[45] Aug. 4, 1981

[54] LOW VISCOSITY OILS

[75] Inventors: Luke A. Schaap, South Holland; John H. Udelhofen, Wheaton; Samuel W. Harris, Naperville, all of Ill.

[73] Assignee: Standard Oil Company (Indiana), Chicago, Ill.

[21] Appl. No.: 82,068

[22] Filed: Oct. 5, 1979

[51] Int. Cl.[3] ..... C10M 1/48

[52] U.S. Cl. ..... 252/32.7 E; 252/33.2; 252/42.7; 252/39; 252/49.6

[58] Field of Search ..... 252/32.7 E, 33.2, 33.4, 252/39, 49.6

[56] References Cited

U.S. PATENT DOCUMENTS

| | | | |
|---|---|---|---|
| 3,290,130 | 12/1966 | Assmann et al. | 252/32.7 E |
| 3,652,410 | 3/1972 | Hollinghurst | 252/32.7 E |
| 3,873,455 | 3/1975 | Schieman | 252/32.7 E |

*Primary Examiner*—Winston A. Douglas
*Assistant Examiner*—J. V. Howard
*Attorney, Agent, or Firm*—Mark DiPietro; William T. McClain; William H. Magidson

[57] ABSTRACT

An improved low viscosity (i.e.) 5 W to 7½ W engine oil resistant to oxidation and consumption comprising a major portion of a lubricating oil stock, a sulfurized oil, a dispersant, an anti-corrosion agent, an anti-rust agent, a detergent, an anti-oxidant, and a viscosity index improver.

7 Claims, No Drawings

LOW VISCOSITY OILS

This invention relates to an improved motor oil having a viscosity of about 5W to 7½W resistant to consumption of the volatile and easily oxidized components which provides improved low temperature startability, economical operation, and protection from deposits and wear to internal combustion engines. While 7½W oils are not yet officially established by SAE, the 7½W viscosity has been proposed as a viscosity midway between 5W and 10W.

The viscosity of motor oils is most often expressed in the SAE number code, for example 5W-30; 10W-40; 20W-50. In the code the first number, for example 5W or 10W, represents that the oil has a maximum viscosity at −17.8° C. (0° F.) below a certain limit. The second number, for example 30 or 40, represents that the viscosity of the oil is within a certain range at 98.9° C. (210° F.). The oils can be identified either with both numbers or with the first number only. A 5W oil includes 5W, 5W-20 up to 5W-50 oils depending on the oil and the additive package contained in the lubricant. In this application the low viscosity oils will be referred to as a 5W or 7½W oil indicating that the invention covers 5W to 5W-50 and 7½W to 7½W-50 single and multigrade oils.

Commercial motor oils have been commonly prepared by blending a viscosity index improver and an additive package into a suitable base oil to make an oil with a viscosity about 10W or 15W to provide adequate protection from wear and harmful deposits to internal combustion engines. The use of a 10W to 15W oil has the drawbacks that the oils commonly cause poor cold weather startability and uneconomical operation. Since at winter temperatures 10W to 15W oils become thick and viscous, a substantial amount of energy is consumed overcoming the viscosity of the oil. The viscosity also reduces the rate the engine can be turned by the starter reducing startability. Since the viscosity increases the demand for energy from starting systems, batteries often become quickly discharged before the engine starts, frustrating the driver. The viscosity of the 10W to 15W oil at ambient and at operating temperatures also causes some substantial resistance to the movement of pistons, cams, and lifters, etc. in the engine. This resistance wastes some of the energy produced by the engine, reducing the economy of operation.

Since oils with low viscosity, i.e., about 5W to 7½W, are less thick and viscous at ambient and operating temperature than the 10W to 15W oil, the low viscosity oils provide easier cold weather startability and more economical operation. Accordingly 5W to 7½W oils have attracted increasing attention to provide ease of starting and improved overall economy for internal combustion engines. 5W to 7½W oils are less viscous than 10W to 15W oils as a result of the presence of greater amounts of lower molecular weight volatile components having a boiling point lower than about 680° F. However, a 5W to 7½W oil containing a variety of conventional additives can suffer from the disadvantage that at the operating temperature of engines, the oil can be consumed or oxidized at a rate greater than a 10W to 15W viscosity oil. The increased consumption is the apparent result of the vaporization and oxidation of the low molecular weight volatile components of the oil. The increased consumption of the oil can deprive the engine of proper lubrication and can create additional harmful deposits.

Thus, a need exists for a fully compounded low viscosity 5W to 7½W motor oil providing both resistance to consumption and protection from wear and harmful deposits.

The principal object of the invention is to improve both the lubrication properties of 5W to 7½W oils and the stability of the oils at operating conditions in internal engines. Another object of the invention is to reduce the tendency of 5W to 7½W oils to be consumed or oxidized at the operating conditions found in internal combustion engines. Still another object of the invention is to formulate a 5W to 7½W oil that provides more economical operation and greater ease of starting in cold weather when compared with 10W to 15W oils. A further object of the invention is to formulate a 5W to 7½W oil that provides protection from wear and harmful deposits, economical operation, and ease of cold weather starting.

We have now found that the objects of our invention can be obtained by blending an effective amount of a sulfurized oil in a major portion of a suitable low viscosity lubricating oil stock containing an effective amount of a dispersant; an anti-corrosion agent; an anti-rust agent; a detergent; an anti-oxidant agent; and a dispersant or non-dispersant viscosity index improver. A low viscosity lubricating oil containing a blend of these addition agents above will provide excellent prevention of wear and harmful deposits in internal combustion engines, and will resist consumption of volatile and easily oxidized components while providing economical operation and ease of cold weather starting.

One aspect of our invention is a low viscosity single or multiple viscosity blended lubricating oil having a viscosity from about 5W to 7½W resistant to the consumption of the highly volatile, easily oxidized components which comprises an effective amount of a sulfurized mineral or fatty oil, a major portion of a suitable base oil combined with an effective amount of a dispersant, an anti-corrosion agent, an anti-rust detergent, an anti-wear agent, an anti-oxidant agent, and a viscosity index improver. A second aspect of our invention is a concentrate of the sulfurized oil, the other addition agents above and about 5 to 50 wt. percent lubricating oil based on the concentrate which can be diluted with base oil to form a fully blended lubricant. The addition agents used to prepare the low viscosity oils of this invention are known to provide detergency, wear protection, reduced friction, dispersancy, corrosion protection, rust inhibition, protection from oxidation and viscosity control. Sulfurized oils are known to provide extreme pressure wear protection and to reduce friction. However, no single addition agent or blend of agents has been shown to reduce consumption of volatile, easily oxidized low viscosity lubricating oils. The combination of the sulfurized oil with these addition agents synergisticly reduces the consumption of the low viscosity oil.

Briefly, the low viscosity oils of this invention are prepared by blending an effective amount of a sulfurized oil, a major amount of a low viscosity lubricating oil and the dispersant, anti-corrosive agent, anti-rust agent, anti-wear agent, anti-oxidant, and viscosity-index improver.

Sulfurized oils suitable for preparing the low viscosity lubricants of this invention are prepared by sulfurizing mineral hydrocarbon oil fractions or by sulfurizing fatty oils.

Commonly, mineral hydrocarbon oils in the lubricating oil distillation range can be sulfurized. However, highly refined, solvent extracted, dewaxed lubricant oils are preferred for their high lubricant quality, and low content of carcinogenic substances. Commonly, lubricating oil stocks are produced by atmospheric or vacuum distillation of crude, and can be solvent extracted in conventional procedures with phenol, furfural, or N-methyl-2-pyrrolidone. The solvent extracted oils can be dewaxed to remove high molecular weight paraffin, isoparaffin, and cycloparaffin waxes by contacting the oil with solvents such as methyl ethyl ketone, benzene, propane, propylene, acetone, etc. to precipitate the wax.

Commonly, the sulfurized mineral oils are prepared by contacting the mineral lubricating oil with from about 0.1 to about 5 weight percent based on the oil of sulfur or other well known sulfurizing agents such as $H_2S$, $S_2Cl_2$, $SCl_2$, etc., which can be added to the oil in single or multiple additions at a temperature from about 100°-260° C. (212°-500° F.) until the sulfur combines with reactive components of the oil. Discussions of the preparation and properties of sulfurized mineral lubricating oils useful in this invention are found in U.S. Pat. Nos. 4,125,471; 2,669,560; 2,356,843; 2,296,037; 2,246,282 which are expressly incorporated by reference herein.

Sulfurized fatty oils can be prepared from fatty oils derived from natural products. Conventionally, liquid triglycerides or semi-solid or solid fats such as hydrogenated or non-hydrogenated fatty oils of animal and vegetable origin, for example vegetable oil, lard, tallow etc. can be sulfurized along with the saponification products thereof. Higher quality sulfurized fatty oils can be prepared from more purified fatty materials, such as purified sperm oil, purified cottonseed oil, purified soy bean oil, etc. Preferably, for reason of economy and ease of reaction the sulfurized fatty oil can be prepared from prime burning lard oil or an alkyl fatty ester such as an alkyl oleate.

The term "prime burning lard oil" used herein refers to the prime burning lard oil article of commerce. Prime burning lard oil is a highly refined lard that has been caustic treated to remove free fatty acids, proteins, and other non-lipid, water soluble biochemical constituents commonly present in commercial lard. Prime burning lard oil commonly contains less than 1 percent free acid as oleic, has a saponification number of about 197 and an iodine number of about 69.

The term "alkyl oleate" used herein indicates a mixture of alkyl esters of saturated and unsaturated fatty acids having 12 to 30 carbon atoms, said mixture containing greater than about 50 weight percent unsaturated fatty acids, not more than 10 weight percent of the unsaturated fatty acids contain conjugated double bonds. The alkyl groups of the alkyl oleate can have about 1 to 20 carbon atoms. Particularly suitable alkyl oleates are methyl oleate, ethyl oleate, isopropyl oleate, tertiarybutyl oleate, amyl oleate, octyl oleate and eicosyl oleate. The alkyl oleates typically contain less than 1.5 percent free acid as oleic acid, about 37 percent saturated acids, and about 58 percent or greater unsaturated fatty acid. The sulfurization of a prime burning lard oil, an alkyl oleate, or mixtures thereof with elemental sulfur is conducted in accordance with conventional sulfurization techniques.

Commonly, the prime burning lard oil, the alkyl oleate or mixtures thereof are heated and contacted with appropriate amounts of sulfur or other sulfurizing agents such as $H_2S$, $SCl_2$, $S_2Cl_2$, etc. at a temperature of about 100°-260° C. (212°-500° F.) for a period of time necessary to solubilize a substantial quantity of the sulfur. Examples of the preparation and properties of sulfurized fatty oils useful in this invention can be found in U.S. Pat. Nos. 2,197,061; 3,740,333; and 3,850,825 which are expressly incorporated by reference herein.

Dispersants useful in producing 5W to 7½W viscosity lubricants of this invention include commonly available oil soluble lubricant dispersants, for example, Mannich dispersants, N-substituted long chain alkenyl succinimides, high molecular weight esters and polyesters of benzoic acid, fatty acids and boric acids. Preferably for reason of high quality, ease of production, economy and availability, Mannich dispersants are preferred.

Mannich dispersants suitable for preparing lubricating oil blends of the invention include the reaction product of either a substituted phenol or an oxidized ethylenically unsaturated olefinic polymer with an amine and a formaldehyde yielding reagent.

Mannich dispersants produced from high molecular weight alkyl phenols are disclosed in U.S. Pat. Nos. 3,539,633; 3,697,574; 3,704,308; 3,736,357; and 3,751,365 which are expressly incorporated herein by reference. Alkyl phenols are commonly prepared by alkylating phenol with an ethylenically unsaturated polymer such as polyisobutylene, polypropene having a molecular weight from about 600 to 3,000, in the presence of an appropriate catalyst.

Mannich dispersant-viscosity index improvers produced from oxidized polymers are disclosed in U.S. Pat. Nos. 3,872,019 and 4,131,553 which are expressly incorporated by reference herein. These Mannich dispersants also provide viscosity index control. Olefinic polymers to be oxidized can be prepared from monomers containing 1 to about 20 carbon atoms, for example, ethene, propene, isobutylene, hexene, decene, 1,3-butadiene, etc. Preferably, suitable ethylene-propylene or ethylene-propylene-diene, copolymers containing about 20 to about 65, preferably about 35 to about 40 mol percent propylene having a number average molecular weight of at least 20,000 to about 200,000 are used. The polymer used to prepare Mannich products is oxidized by contacting the copolymer under suitable conditions of temperature and pressure with an oxidizing agent such as air or free oxygen or any oxygen-containing material capable of releasing oxygen under these conditions.

Amine reactants useful in preparing the Mannich dispersants of this invention are primary and secondary aliphatic amines and polyalkylene polyamines having the general formula $NH_2[(CH_2)_zNH]_xH$ wherein z is a number from 2 to 6 and x is an integer from 1 to 10. Illustrative of suitable amines are methylamine, dibutylamine, ethylenediamine, trimethylenediamine, tetramethylenediamine, hexamethylenediamine, diethylenetriamine, triethylenetetraamine, tetraethylene pentamine, etc.

Commonly available formaldehyde yielding reagents used in preparing the Mannich dispersants include formalin, paraformaldehyde, trioxane, trioxymethylene, gaseous formaldehyde, etc. Commonly the alkyl phenol or oxidized polymer is dissolved in oil and reacted with the polyamine and the formaldehyde yielding reagent at elevated temperature. The product is stripped of volatile components, filtered and is ready for use.

Anti-corrosion agents include metal dithiophosphates, sulfurized and phosphosulfurized terpenes and metal dihydrocarbyldithiophosphates. For reasons of availability, low cost and high performance metal dihydrocarbyldithiophosphates are preferred. Metal dihydrocarbyldithiophosphates are prepared by the neutralization reaction of a metal compound and dihydrocarbyl dithiophosphoric acids produced by the reaction of a hydrocarbyl monohydroxy compound with phosphorus pentasulfide.

Hydrocarbyl monohydroxy compounds useful in the production of dihydrocarbyldithiophosphoric acids comprise both aliphatic and aromatic monohydroxy compounds, for example, methanol, ethanol, propanol, isopropanol, butanol, isobutanol, tertiary butanol, pentanol, hexanol, cyclohexanol, decanol, eicosanol, pentacosanol, hectanol, phenol, naphthol, 4-methylphenol, dodecyl phenol, didodecyl phenol, polyolefin substituted phenol with molecular weight from about 200 to 1,400, etc. Useful monohydroxy compounds can contain from about 1 to about 100 carbon atoms. Preferably, increased performance can be provided by using a mixture of monohydroxy compounds including both aliphatic and aromatic monohydroxy compounds.

Commonly, metal compounds of calcium, barium, lead, cadmium, copper, zinc, aluminum, magnesium are used to neutralize the dihydrocarbyldithiophosphoric acid. Preferably, zinc compounds such as ZnO and $Zn(NO_3)_2$ are used providing the highest level of anti-wear and load bearing properties to the oil.

Details of the preparation and properties of metal dihydrocarbyldithiophosphate are found in U.S. Pat. Nos. 2,837,549; 3,290,347; 3,361,668; 3,086,939; 3,168,497; 3,471,540 which are expressly incorporated by reference herein. Commonly, about 2 moles of phosphorus pentasulfide is reacted with about 8 moles of monohydroxy compound in an inert medium such as hexane, heptane, or lubricating oil to prepare the dihydrocarbyl dithiophosphoric acid. The mixture is heated and stirred at an elevated temperature from about 100° to about 200° C. until the reaction is complete. The mixture is stripped of volatiles and then can be neutralized with about 4 moles of a metal compound such as zinc oxide. The reaction is commonly performed so that the temperature does not exceed about 95° C. Water of neutralization is removed, the mixture is filtered, and is ready for use.

Detergent agents include neutral and overbased sulfonates, neutral and overbased phosphonates and thiophosphonates; neutral and overbased sulfurized phenates, and neutral and overbased salicylates. Sulfonates and sulfurized phenates are preferred for reasons of performance, low cost, the anti-oxidant property of the sulfurized phenate, and the anti-rust property of the sulfonate.

Alkaline earth metal sulfonates having additional anti-rust activity useful in preparing the lubricating oil blends of this invention are prepared from a sulfonic acid, an alkaline earth metal compound, a lower alkanol, ammonia, carbon dioxide, and water. Commonly, overbased alkaline earth metal sulfonates contain greater than the stoichiometric amount of alkaline earth metals to neutralize the sulfonic acids. Commonly, magnesium, calcium, or barium overbased sulfonates are prepared by the reaction of the sulfonic acid compound containing 0 to 100 weight percent oil soluble ammonium sulfonate with a stoichiometric excess of a hydratable magnesium, calcium, or barium compound based on the sulfonic acid, water, in the presence of a lower alkanol such as methanol, ethanol, propanol, etc. and at least one substantially inert diluent. The mixture is heated to hydrate the magnesium, calcium or barium compound. Once hydration is complete the mixture is preferably heated to remove substantially all of the lower alkanol and the mixture is carbonated with carbon dioxide at a temperature between about 80° F. to 155° F. to form the amorphous magnesium, calcium, or barium overbased sulfonate material. Details of the preparation and properties of these overbased materials can be found in U.S. Pat. Nos. 3,126,340; 3,524,814; 3,609,076; and 4,137,186 which are expressly incorporated by reference herein.

Neutral and overbased alkaline earth metal sulfurized phenates having additional anti-oxidant activity useful in preparing the lubricating oil blends of this invention are prepared from an alkyl phenol, an alkaline earth metal salt, a promoter, sulfur, and water. Neutral alkaline earth metal phenates are the products of commonly a one-step reaction of a mixture of alkylphenols having 9–12 carbon atoms such as dodecyl or nonylphenol, with elemental sulfur in the presence of an alkaline earth metal such as calcium hydroxide, a promoter such as ethylene glycol, and oil at temperatures sufficient to effect sulfurization of the phenol. At the end of the reaction, water and glycol are removed from the product mixture and the mixture is filtered. Overbased alkaline earth metal phenates are prepared by carbonating prior to the removal of ethylene glycol the reaction product of an alkylphenol, elemental sulfur, a stoichiometric excess based on the phenol of an alkaline earth metal base, ethylene glycol, and oil. During and after the carbonation, additional amounts of an alkaline earth metal hydroxide such as calcium hydroxide can be added. At the end of the carbonation the ethylene glycol and water are removed and the product mixture is filtered. Details of the preparation of neutral or overbased metal sulfurized phenates are detailed in U.S. Pat. Nos. 2,362,289; 2,362,393, 2,680,096; and 3,036,971 which are expressly incorporated by reference herein.

Viscosity index improvers and dispersant viscosity index improvers are added to lubricants to provide a lubricant oil with dispersancy and acceptable viscosity at high temperature. Viscosity index is defined in Hobson and Pohl, *Modern Petroleum Technology,* Halsed Press, John Wiley and Son (1973) pp. 730–732. Viscosity index improvers suitable for preparing the fully compounded oils of this invention are chemicals added to lubricating oils to make them conform more closely to the ideal lubricating oil viscosities. The viscosity of an ideal lubricant will exhibit minimum decrease as temperature increases. All commercially important viscosity index improvers in use today are oil soluble organic polymers. These polymers exert a greater thickening effect on oil at high temperature than at low temperature. The result of such selective thickening is that the oil suffers less viscosity loss in the presence of the polymer as the temperature increases. Dispersant viscosity index improvers contain monomer units or additional polar groups attached to the polymer such as substituted or unsubstituted amino or polyol groups to provide dispersancy to the agent. Current commercial dispersant and nondispersant viscosity index improvers belong to the following families of polymers: polyacrylamides; polyisobutylenes; polymethacrylates, including copolymers of various chain length alkyl methacrylates; polyvinyl acetate; polymers of fumaric acid; fumaric acid ester copolymers; polyacrylates, including copolymers of various chain length alkylacrylates. Specifically, alkyl methacrylate-vinyl pyrolidinone copolymers; alkyl methacrylatedialkylaminoethyl methacrylate copolymers, alkyl methacrylate-polyethylene glycol methacrylate copolymers, aminated and Mannich products of olefin copolymers and terpolymers; styrene-butadiene derivatives etc. are effective dispersant viscosity index improving agents. Details of preparation of the use of these viscosity index improving polymers are found in U.S. Pat. Nos. 3,136,743; 2,936,300; 2,604,453; 2,486,493 which are expressly incorporated by reference herein.

Suitable lubricating oils useful for compounding the finished lubricating oil of this invention include solvent extracted, dewaxed, and hydrotreated petroleum oil and synthetic oils which are treated and blended to provide a 5W to 7½W oil. 5W oils commonly have a maximum viscosity at −17.8° C. (0° F.) of 1,200 cP, 1,300 cSt, and 6,000 SUS. So-called "7½W" oils have a maximum viscosity at −17.8° C. (0° F.) of 1,800 cP, 1,950 cSt, and 9,000 SUS. 5W-30 and 7½W-30 oils have a minimum viscosity at 98.9° C. (210° F.) of 9.6 cSt and 58 SUS, and a maximum viscosity at 98.9° C. (210° F.) of 12.9 cSt and 70 SUS. 5W-40 and 7½W-40 oils have a minimum viscosity at 98.9° C. (210° F.) of 12.9 cSt and 70 SUS and a maximum viscosity of 16.8 cSt and 85 SUS.

In somewhat greater detail, appropriate quantities of each of the addition agents discussed above can be blended into appropriate amounts of low viscosity lubricating oil base stocks. Commonly, the fully compounded low viscosity oil will contain a major portion of a lubricating oil base stock and about 0.1 to 5.0 parts by weight of the sulfurized mineral or fatty oil; about 1.0 to 10.0 parts by weight of the dispersant; about 0.1 to 5.0 parts of the detergent; about 0.1 to 5.0 parts by weight of the anti-corrosion agent; about 0.1 to 5.0 parts by weight of the anti-rust agent; about 0.1 to 5.0 parts by weight of the anti-oxidant agent; and about 1.0 to about 20 parts by weight of the dispersant or non-dispersant viscosity index improving oil soluble polymer each per 100 parts by weight of the fully compounded low viscosity internal combustion engine lubricating oil.

An effective lubricant must contain a detergent, a dispersant, an anti-corrosion agent, an anti-rust agent, an anti-oxidant agent, and a viscosity index improver. Often a single addition agent can have multiple properties, and can be blended in the oil to perform multiple functions. In the instance a dispersant viscosity index improver is used, the Mannich dispersant can be replaced in whole or in part by an effective amount of a dispersant viscosity index improver, such as the Mannich dispersant viscosity index improver made from the oxidized polymer. Both the overbased sulfonate anti-rust agent and the overbased phenate anti-oxidant agent have detergent properties, and can be substituted for each other to a large extent and can replace the detergent. However, at least 0.1–0.5 parts each of the sulfonate and the phenate are preferably present to maintain both the anti-rust and anti-oxidant activity. No substitute for the sulfurized mineral or fatty oil or the viscosity index improver can be used.

The oil concentrate of the specific addition agents in a relatively small amount of lubricating oil base stock which is specifically adapted for blending into lubricating oil stocks to produce a fully compounded oil will contain a major portion of a low viscosity oil; about 5.0 to 10.0 parts by weight of the sulfurized oil; about 10.0 to 50.0 parts by weight of the Mannich dispersant; about 20.0 to 5.0 parts by weight of the metal dihydrocarbyldithiophosphate anti-corrosion agent; about 20.0 to 5.0 parts by weight of the overbased alkaline earth metal sulfonates anti-rust detergent; about 20.0 to 5.0 parts by weight of the neutral or overbased alkaline earth metal sulfurized phenate anti-oxidant detergent and about 1.0 to 40 parts by weight of the polymeric viscosity index improving additive each per one hundred parts by weight of the oil concentrate. The lubricating oils containing these proportions of addition agents provide protection from wear and deposit formation in internal combustion engines, increased resistance to consumption of the low viscosity, high volatility oil at high engine temperatures, economical operation, and ease of starting in cold weather.

The fully compounded low viscosity lubricating oils of this invention can be blended in commonly used commercial blending units. For small volume production of these lubricants appropriate quantities of each addition agent and lubricating oil base stock can be added to a suitable container which is agitated mechanically. For large volumes of lubricating oil the addition agents can be added to a large vessel equipped with pneumatic agitation such as the injection of compressed air through the bottom of the vessel or other means suitable for large scale mixing. Both the addition agents and the lubricating oil can be heated to reduce the viscosity and promote rapid blending of the components.

Internal combustion engine lubricants are tested in the standard sequence IIID test for ability to prevent or minimize varnish, and sludge at high temperature, high speed and load without substantial oxidation or consumption of the oil. In the IIID test a test oil is loaded into an Oldsmobile 350 cubic inch V-8 engine equipped with an oil pan sump maintained at 300° F. The engine is run with a fuel blended to maximize sludge and varnish at 3,000 rpm for 64 hours at a 100 brake horsepower load. Every 8 hours the viscosity of the oil is measured and oil is added according to a specific schedule. At the end of 64 hours the engine is disassembled and examined for wear, and varnish, and sludge deposits.

EXAMPLE I

Into a suitable blending vat equipped with a mechanical agitator was placed 27.39 kg (60 pounds 10 oz.) of a suitable 5W base oil, 2.49 kg (5 pounds 8 oz.) Acryloid A-953 dispersant viscosity index improver, 3.25 kg (7 pounds 3 oz.) of an additive concentrate containing 17.16 (wt) % of a Mannich product of an alkyl phenol molecular weight about 2,000, formaldehyde, and polyamine, 4.86 (wt) % of a zinc dialkyl dithiophosphate, 5.86 kg. overbased magnesium polypropyl benzene sulfonate, 4.71 (wt) % calcium nonyl/dodecyl sulfurized phenol, and 1.23 (wt) % Dow-Corning 200 fluid anti-foam agent. The mixture was blended until uniform.

EXAMPLE II

Example I was repeated except that an additional 746 grams (1 pound, 11 ounces) of a sulfurized mixture of 50 wt.% of prime burning lard oil and 50 wt.% of octyl oleate was added.

TABLE I

| IIID TEST RESULTS OF LUBRICANTS IN EXAMPLES I AND II | | | | |
|---|---|---|---|---|
| | Ave. Sludge | Ave. Varnish | Piston Varnish | Oil Consumption |
| Ex. II | 9.62 | 9.39 | 5.74 | 7.03 qts.* |
| Ex. I | — | — | — | Test interrupted due to excessive oxidation and consumption of the oil prior to accumulating 64 hrs. |

*passing = less than 7.38 qts. of oil consumed.

As can be seen from the above examples and data, the addition of 2.0 (wt)% of the sulfurized oil significantly reduced the oil consumption during the IIID test. Since the sulfurized oils are commonly considered to be friction reducers and extreme pressure additives, the reduced consumption of the 5W and 7½W oils is entirely unexpected.

The above is a discussion illustrative of the Applicants' invention. However, since a variety of modifications can be made within the invention, the invention resides in the claims appended hereinafter.

We claim:

1. An internal combustion engine lubricating oil having a viscosity about 5W to 7½W resistant to the consumption of the volatile, easily oxidized components which comprises a major portion of a suitable base oil and an amount of a sulfurized oil sufficient to reduce oil consumption, a dispersant, an anti-corrosion agent, an anti-rust agent, a detergent, an anti-oxidant, and a viscosity index improver.

2. The lubricating oil of claim 1 wherein the sulfurized oil comprises a sulfurized fatty oil and is present at a concentration of about 0.1 to 5.0 parts by weight per one hundred parts by weight of the lubricating oil, and the viscosity index improver is a dispersant viscosity index improver.

3. A fully compounded internal combustion engine lubricating oil having a viscosity of about 5W to 7½W resistant to the consumption of the volatile, easily oxidized components which comprises a suitable low viscosity base oil, and (a) about 0.1 to 5.0 parts by weight of a sulfurized oil;
(b) about 1.0 to 10.0 parts by weight of a Mannich dispersant;
(c) about 0.1 to 5.0 parts by weight of a zinc hydrocarbyldithiophosphate anti-corrosion agent;
(d) about 0.1 to 5.0 parts by weight of an overbased magnesium sulfonate anti-rust detergent;
(e) about 0.1 to 5.0 parts by weight of a neutral or overbased calcium sulfurized phenate anti-oxidant-detergent;
(f) about 1.0 to 20.0 parts by weight of a viscosity index improver;

each per 100 parts by weight of the fully compounded internal combustion engine lubricating oil.

4. The lubricating oil of claim 3 wherein the sulfurized oil is a sulfurized fatty oil, and the viscosity index improver is a dispersant viscosity index improver.

5. A lubricating oil concentrate for dilution with base oil to form a lubricating oil having a viscosity of about 5W to 7½W which comprises a suitable low viscosity base oil, and (a) about 5.0 to 10.0 parts by weight of a sulfurized oil;
(b) about 10.0 to 50.0 parts by weight of a Mannich dispersant;
(c) about 20.0 to 5.0 parts by weight of a metal dihydrocarbyl dithiophosphate anti-corrosion agent;
(d) about 20.0 to 5.0 parts by weight of an overbased alkaline earth metal sulfonate anti-rust detergent;
(e) about 20.0 to 5.0 parts by weight of a neutral or overbased alkaline earth metal sulfurized phenate anti-oxidant detergent;

each per 100 parts by weight of the oil concentrate.

6. The low viscosity lubricating oil concentrate of claim 5 containing additionally 1.0 to 40.0 parts by weight of a viscosity index improver per 100 parts of the concentrate.

7. The low viscosity lubricating oil concentrate of claim 6 wherein the viscosity index improver is a dispersant viscosity index improver.

* * * * *